United States Patent [19]

Bögner et al.

[11] 4,356,735

[45] Nov. 2, 1982

[54] STARTING MECHANISM FOR INTERNAL COMBUSTION ENGINES

[75] Inventors: Karl-Heinz Bögner, Neuhausen; Martin Mayer, Sersheim, both of Fed. Rep. of Germany

[73] Assignee: Robert Bosch GmbH, Stuttgart, Fed. Rep. of Germany

[21] Appl. No.: 214,517

[22] Filed: Dec. 9, 1980

[30] Foreign Application Priority Data

Mar. 6, 1980 [DE] Fed. Rep. of Germany ..... 3008623

[51] Int. Cl.[3] ..... F02N 15/06

[52] U.S. Cl. ..... 74/7 A; 335/274

[58] Field of Search ..... 74/6, 7 R, 7 A; 290/38 L; 335/274

[56] References Cited

U.S. PATENT DOCUMENTS 3,209,603 10/1965 Rodriguez ..... 74/7 A 3,223,863 12/1965 Preece et al. ..... 74/7 A X

FOREIGN PATENT DOCUMENTS 190743 7/1957 Fed. Rep. of Germany ..... 74/7 A

OTHER PUBLICATIONS

*Automotive Handbook,* 18th German Edition, 1st English Edition, pp. 372–373, Bosch, "Starting Motors", 1976.

*Principles of Automotive Vehicles,* Departments of the Army and the Air Force, Army Technical Manual TM9-8000, Jan. 1956, pp. 193–195.

*Primary Examiner*—Allan D. Herrmann

*Attorney, Agent, or Firm*—Frishauf, Holtz, Goodman & Woodward

[57] ABSTRACT

The starting mechanism has a solenoid switch combination 11 for causing gear meshing engagement of a drive pinion 4 with a gear 31 of an internal combustion engine via an engagement lever 16 and a gear engagement mechanism 5–8. A pre-compressed spring 28 is disposed between the engagement lever 26 and the armature 18. The force of that spring aids the magnetic force of the solenoid switch 11 for pulling the armature 18 into the solenoid 11 against the force of a gear mesh spring 21 if the pinion 4 and the gear 31 are in the tooth-to-tooth position to engage the starter motor switch of the combination 11 and cause rotation of the motor, permitting engagement of the pinion 4 and gear 31.

4 Claims, 1 Drawing Figure

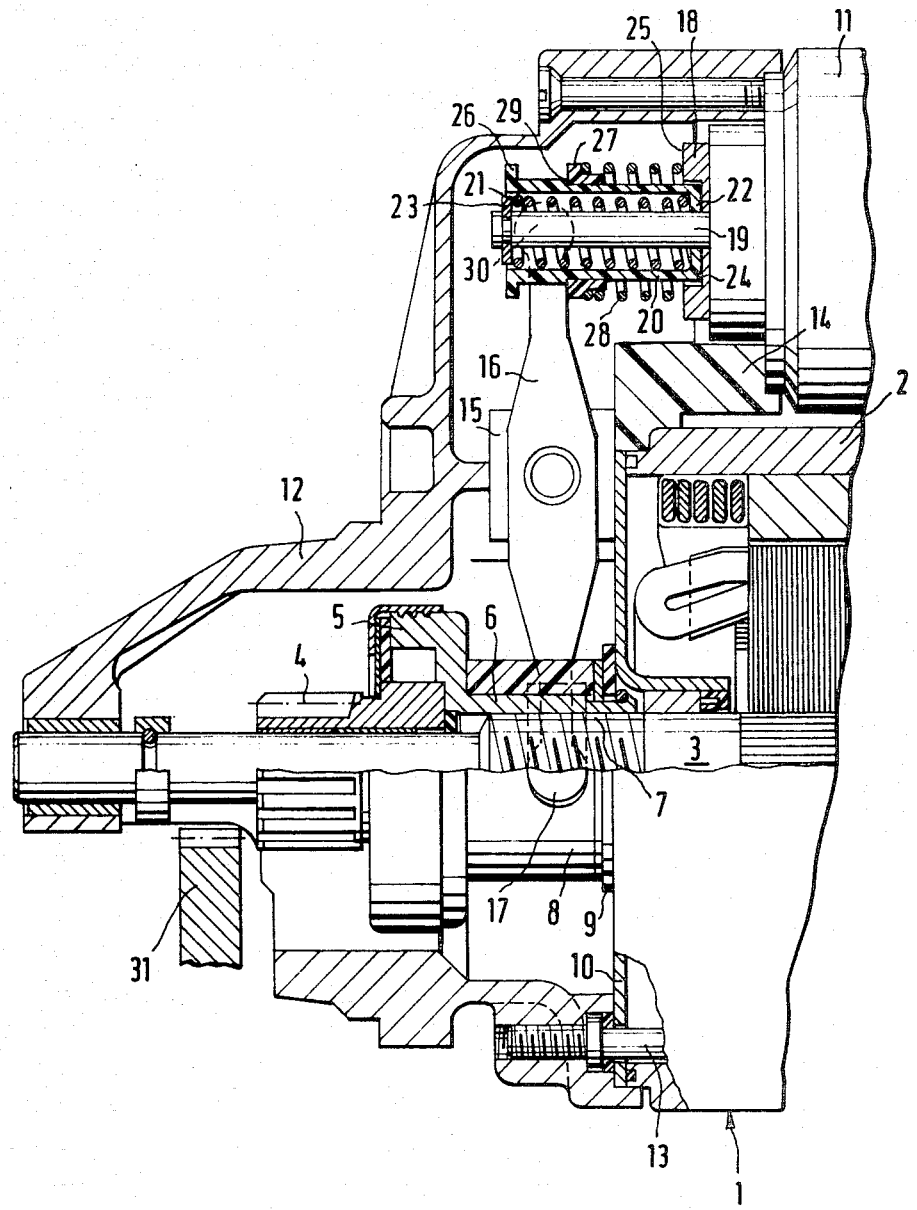
25
18
11
26
29
27
21
22
23
19
30
24
28
20
14
16
2
15
12
5
6
4
3
7
17
8
9
31
10
13
1

STARTING MECHANISM FOR INTERNAL COMBUSTION ENGINES

This invention relates to a starting system for an internal combustion engine including a starter motor and a coupling mechanism to couple the motor to a starter gear.

BACKGROUND

Known starting systems have the disadvantage that, when the starter pinion meets the gear teeth of the starter gear, secured to the fly wheel of the internal combustion engine which is to be started in a tooth-to-tooth position, the solenoid switch must exert a relatively high magnetic force. During the process of gear engagement, the force of a turn-off, and gear disengagement, or return spring has no effect. This spring is used to electrically disconnect the solenoid and hence the starting mechanism from the current supply, if energization of the starter motor did not result in starting the engine, and to return the starter elements to rest position.

THE INVENTION

It is an object to provide a starter system in which the starting relay can be made of lighter gauge wire, thus saving copper, and further reducing the size of the starter unit.

Briefly, a solenoid switch combination is provided causing gear meshing engagement of a drive pinion with a gear of an internal combustion engine, by moving an engagement lever and a gear engagement mechanism, as well known. In accordance with the invention, a precompressed spring is located between the gear engagement lever and the armature so that, in case the engagement lever 16 cannot move for the full intended stroke if the pinion of the starter and the gear on the engine are in tooth-to-tooth position and the engagement lever then forming a stop for the precompressed spring which acts in the direction of magnetic force of the solenoid, the spring assists the solenoid in its pull-in operation, to continue to move a solenoid plunger until the switch element of the solenoid engages, causing rotation of the starter motor and hence relative angular shifting of the pinion on the starter and the engine starter gear. This changes the tooth-to-tooth position to a tooth-gap position, permitting full travel of the engagement lever and engagement of the then rotating starter pinion with the starter gear of the engine and starting of the engine.

The starting mechanism has the advantage that the precompressed spring is so located that, if the starter pinion meets the fly wheel gear teeth in a tooth-to-tooth position, the spring engages a fixed stop and can exert a force on the magnet armature and thus aid the force with which the solenoid pull-in the armature, so that the solenoid may be built with a smaller winding representing a saving in copper.

DRAWING

The single FIGURE shows a part of a starting mechanism in partial longitudinal section.

A starting mechanism for internal combustion engines includes a starter motor 1 having a housing 2 and a drive shaft 3. A gear engagement drive is movably disposed on the drive shaft 3. The gear engagement drive includes a starter pinion 4 which is coupled to a rotation transmitting sleeve 6 by a an overrunning device 5. The force transmitting sleeve 6 is disposed on a high-pitch thread portion 7 of the drive shaft 3. The force transmitter sleeve 6 carries a plastic bushing acting as an engagement sleeve 8 and brake discs 9. The brake disc 9 and an intermediate bearing 10 which covers the face of the housing 2 and through which extends the drive shaft 3, represent an arresting brake for the starter motor 1.

Attached to the side of the housing 2 of the starter motor 1 is a solenoid switch combination 11. A drive bearing housing 12 is attached to the face of the housing 2 and of the solenoid switch 11 by means of a tensile anchor bolt 13. A sealing member 14 is inserted between the housing 2, the solenoid switch 11 and the drive housing 12. The sealing member 14 is aligned in recesses of the housing 12 and makes contact with a bearing part 15 also disposed on the housing 12. Pivotably attached to the bearing part 15 is an engagement lever 16. The engagement lever 16 has a fork-shaped terminal section the ends 17 of which engage recesses on the circumference of the sleeve 8.

The solenoid switch 11 includes an armature 18 to which is attached an armature rod 19 which extends into the drive bearing housing 12. A plastic bushing 20 moves on the armature rod 19. A gear mesh spring 21 is disposed within the sleeve 20. The spring 21 is supported at one end on the base 22 of the sleeve 20 and its other end is supported on a stop disc 23 at the end of the armature rod 19. The base 22 of the sleeve 20 is located in a recess 24 at the face 25 of the armature 18. The drawing shows the parts in de-energized position. The other end of the sleeve 20 carries a flange 26. A carrier ring 27 is movably disposed on the sleeve 20. A turn-off, or return spring 28 is inserted, with pre-stress compression, between the carrier ring 27 and the face 25 of the armature 18. The spring 28 presses the carrier ring 27 against an annular shoulder 29 on the casing of the sleeve 20. The upper terminal section of the engagement lever 16 is also fork-shaped. The ends 30 of the fork laterally engage the sleeve 20 between the flange 26 and the carrier ring 27.

Operation:

When the internal combustion engine is to be started, the solenoid switch 11 component of the solenoid-switch combination is coupled in known manner to a current source, not shown. The armature 18 is pulled into the solenoid 11. In this process, the gear mesh spring 21 presses the sleeve 20 to face 24, 25 of the armature 18 so that the flange 26 which bears on the fork ends 30 causes the engagement lever 16 to be pivoted in the clock-wise sense around its pivot on the bearing part 15. During this movement, the engagement lever 16 acts via the engagement bushing 8 which is located immovably on the force transmitter sleeve 6 to advance the gear mesh mechanism 4–6 toward the gear teeth 31 of the fly wheel of the internal combustion engine.

(a) Normal gear engagement:

If the starter pinion 4 meets the gear 31 in the tooth-to-gap position, it can mesh immediately. The switch component of the solenoid switch combination 11 then couples the starter motor 1 to the current source in a known manner to rotate the motor and start the engine. The starter motor 1 receives the full amount of current and rotates the internal combustion engine.

Once the internal combustion engine has started, the starting mechanism is switched off. The starter pinion 4 disengages from the gear 31, the engagement mechanism 5, 6, 8 returns to its normal position with the aid of a return spring (not further shown) in customary manner which moves the engagement lever 16 and the armature 18 back into their normal position as shown in the FIGURE and holds them in this position until the occurrence of the next starting process.

(b) gear teeth in opposition

If the starter pinion 4 advances in the tooth-to-tooh position with respect to the gear 31, the gear engagement mechanism 4–8 and the engagement lever 16 can not advance farther. Yet, the armature 18 is subjected to the magnetic force exerted by solenoid components of the solenoid switch combination 11. To assist the solenoid, the mechanical force of the pre-stressed decoupler spring 28 is used. Spring 28 is supported by the engagement lever 16, 30 which is arrested during this time and which serves as a stop for the carrier ring 27, which in turn supports the left end of spring 28. As the armature 18 continues to be pulled into the solenoid, the gear mesh spring 21 is compressed by the armature rod 19 and the stop disc 23. When the armature 18 arrives at the switching position for the starter motor 1, motor 1 starts to rotate and thus turns the starter pinion 4 which will mesh into the nearest tooth-to-gap position with gear 31, by means of the drive shaft 3, the high-pitch thread 7, the force transmitter sleeve 6 and the free wheeling device 5. The force of the gear mesh spring 21 transmitted to the engagement lever 16, 17, 30 via the bushing 20, 22, 26 then permits the engagement lever 16 to rotate in the clockwise sense and to cause the engagement mechanism to place the starter pinion 4 into meshing engagement with the gear 31.

The highest pull-in force for the armature 18 of the solenoid 11 is required during the starting process in a tooth-to-tooth position. The force must pull the armature 18 into the solenoid 11 and also compress the gear mesh spring 21. The assistance for the pull-in force of the solenoid switch 11 by the mechanical force of the spring 28 during this portion of the starting process makes it possible to provide a solenoid switch 11 with a smaller winding.

This saves expensive copper without the use of additional parts, leading to an economical manufacture, especially in mass production. The spring 28 is placed, between the engagement lever 16 which, when is arrested in the tooth-to-tooth position forms a stop for the spring and the armature 18 of the solenoid 11. The gear mesh spring 21 is also located on the armature 18 which permits to a shorter length of construction of the starting mechanism.

We claim:

1. A starting mechanism for an internal combustion engine having a starter motor (1) having a drive shaft (3);

a starter pinion (4) having gear teeth slidably located on the drive shaft, the gear teeth being adapted for engagement with the teeth of a meshing gear coupled to the internal combustion engine;

a force transmitting mechanism (5-8) including a coupling sleeve (8) and an overrunning gear (5) located on the drive shaft and slidably coupled to the starter pinion;

a pivotably located engagement lever (16) having one fork-shaped end pivotably attached to the force transmitting sleeve (8) for sliding the force transmitting mechanism, and hence the starter pinion on the drive shaft;

a solenoid-switch combination unit (11) having a reciprocable elongated armature (18) and an operating rod (19) forming part thereof;

a bushing (20) surrounding the operating rod;

a first spring (21) interposed between the bushing and the operating rod to couple the operating rod and the bushing;

a carrier ring (27) slidable on the bushing, the other end of the engagement lever being operatively coupled between said carrier ring (27) and the end (26) of the bushing (20) remote from the armature (14);

and a pre-compressed spring (28) located between the carrier ring and the end face of the armature for urging the carrier ring away from the face of the armature and to entrain the other end of the engagement lever (16) between the carrier ring and the end of the bushing, while exerting a force against the end face of the armature, to assist the magnetic pull-in force of the solenoid if the lever cannot follow the operating rod in case the pinion (4) and the gear (31) on the internal combustion engine are in tooth-to-tooth position.

2. Mechanism according to claim 1, wherein the bushing (20) is formed with a stop (29) intermediate its length, the carrier ring (27) being slidable on said bushing up to said stop and entraining the other end of the engagement lever (16) at predetermined positions between the carrier ring and the end (26) of the bushing (20) remote from the armature.

3. Mechanism according to claim 2, wherein the end of the bushing (20) remote from the armature is formed with a flange (26) to entrain the other end of the engagement lever (16) between said flange and the carrier ring (27).

4. Mechanism according to claim 1, wherein said force transmitting sleeve (8) is formed with circumferentially located recesses, engaged by the fork-shaped end of said engagement lever (16).

* * * * *